United States Patent [19]

Martin

[11] 4,271,546

[45] Jun. 9, 1981

[54] INFLATABLE LIFT FOR PATIENT'S BEDPAN USE

[76] Inventor: Mary Martin, 710 W. Third St., Aspen, Colo. 81611

[21] Appl. No.: 60,171

[22] Filed: Jul. 24, 1979

[51] Int. Cl.[3] ..... A61G 9/00

[52] U.S. Cl. ..... 5/90; 4/457; 5/81 R; 5/434; 5/441

[58] Field of Search ..... 5/81 R, 90, 441, 431, 5/434; 128/1, 132, 133; 4/113, 185 R, 185 L, 237

[56] References Cited

U.S. PATENT DOCUMENTS

| | | | |
|---|---|---|---|
| 3,020,910 | 2/1962 | Ward | 128/132 R |
| 3,535,719 | 10/1970 | Mucott | 128/133 |
| 3,729,749 | 5/1973 | Rosecrams | 4/113 |
| 3,978,531 | 9/1976 | Iion | 5/431 |

*Primary Examiner*—Casmir A. Nunberg

*Attorney, Agent, or Firm*—Hume, Clement, Brinks, William & Olds, Ltd.

[57] ABSTRACT

This invention relates to a device to be used by patients who when confined to bed are required to use bedpans and in particular a device having an inflatable portion that is so located in relation to the patients body as to exert a lifting force adjacent the base of the patient's spine so as to raise the lower body portion of the patient's torso and thus to allow with or without some cooperation of the patient the insertion of a bedpan under the patient in a proper position for use by the patient. The device is characterized as being constructed to be placed on the body of the patient and be worn so to speak, by the patient throughout the day or night, or both, in a deflated state and be maintained at all times of possible need, in place and in a state of readiness to be inflated with air or gas from a source under pressure such as a tank, individual can or a pump so as to lift the patient's body as required without resorting to manual lifting.

13 Claims, 6 Drawing Figures

INFLATABLE LIFT FOR PATIENT'S BEDPAN USE

This invention relates to a new and improved lifting device for patients who are confined to bed and particularly a device that can be worn around the lower torso of the patient and is equipped with an inflatable member adjacent the base of the patients spine which is capable, when inflated, of lifting the buttocks of the patient an amount sufficient to permit the insertion of a bedpan under the patient in a position for use by the patient.

BACKGROUND OF THE INVENTION

At the present state of development of the medical equipment art there is a great need for a device which will lift the hip region of a helpless patient while reclining in bed so that a bedpan can be inserted under the buttocks in position to be used by the patient. At the present time it is customary for one or more attendants to manually lift the hips of the patient until raised sufficiently to allow a bedpan to be inserted under the patient or to roll the patient on to his side and after placing a bed pan on the bed adjacent the patients buttocks to roll the patient back onto the bedpan. The practice of lifting is difficult at best and actually cannot be performed by many attendants and both practices usually are either uncomfortable or, quite painful, or both.

Prior art devices providing an inflatable lift for this same purpose have been proposed but in all cases the problem of getting the lifting device under the patient remains. Such a device is shown in U.S. Pat. No. 3,728,744, but it will be observed that the device there disclosed must be inserted under the patient when its use is undertaken. It is found that lifting the patient for the insertion of the device under the patient can be and often is as difficult and troublesome as lifting the patient for the insertion of a bedpan.

SUMMARY OF THE INVENTION

It has now been discovered that a device of the type here disclosed can be employed to apply a lifting force to the general region of the base of the spine of the patient rather than to the buttocks with the result that the buttocks area of the patient will also be lifted. Thus it is now known that the old practice of locating the inflatable lift under the buttocks of the patient is not necessary. By locating the lift portion of the device adjacent the base of the spine the buttocks area of the patient is also lifted and at the same time left unobstructed so as to freely accommodate a bedpan, particularly when the knees of the patient can be flexed upwardly either with the cooperation of the patient and by an attendant.

In order to so locate the inflatable portion of the device in the manner described it may be formed as a portion of a belt-like strip of fabric or similar material of suitable width which can be wrapped around the patient at the lower portion of the patient's torso and fastened end to end in front by suitable means and thus be worn by the patient while reclining in bed. When not functioning as a lift the device remains deflated and constitutes a flexible garmentlike wrapping which need not constitute a source of discomfort to the patient.

The device of this invention may be thus applied to the patient on an occasion when the patient is standing or sitting up in bed which may be once a day or less frequently if necessary, and be worn by the patient throughout the day and night without creating a source of discomfort. When thus worn the device remains at all times in proper place and in complete readiness to be inflated by the release of compressed air or gas which can actually be effected at will by the patient without the necessity of having an attendant present.

As will be more fully described below the belt-like strip serves as the base member on which the inflatable member is mounted. The inflatable member is preferably made of a flexible impervious material and is constructed to lie flat and smooth when not inflated and to balloon when fully inflated to a shape that will lift the patient approximately 3½ or 4 inches. Furthermore, the inflatable portion of the device is preferably attached to the belt-like strip by connecting elastic members, on each side, by attaching such members as by sewing one end of each elastic member to the belt-like strip and the other end of each elastic member respectively to the adjacent end of the inflatable member. This construction allows the inflatable member to balloon upwardly to lift the patient when fully inflated and to cause the connecting elastic members on each side to stretch and elongate to accommodate the movement of the ends of the inflatable member as they approach each other during the ballooning action.

The inflatable member is connected by a flexible tube to a source of pressurized air or gas. The tube enters the inflatable member on the side so as not to constitute an object of discomfort under the back of the patient and is connected to a pressure source by means including a control valve which can, if desired, be maintained within the reach of the patient. When deflated the elastic members serve to pull the ends of the inflatable member in opposite directions so as to cause it when fully deflated to constitute two flat layers of material which with the belt-like strip will be free of bulky or lumpy portions disposed between the back of the patient and the bed. Accordingly, the comfort of the patient is maintained at all times.

DESCRIPTION OF THE PREFERRED EMBODIMENT

In the drawings

Figure 1:
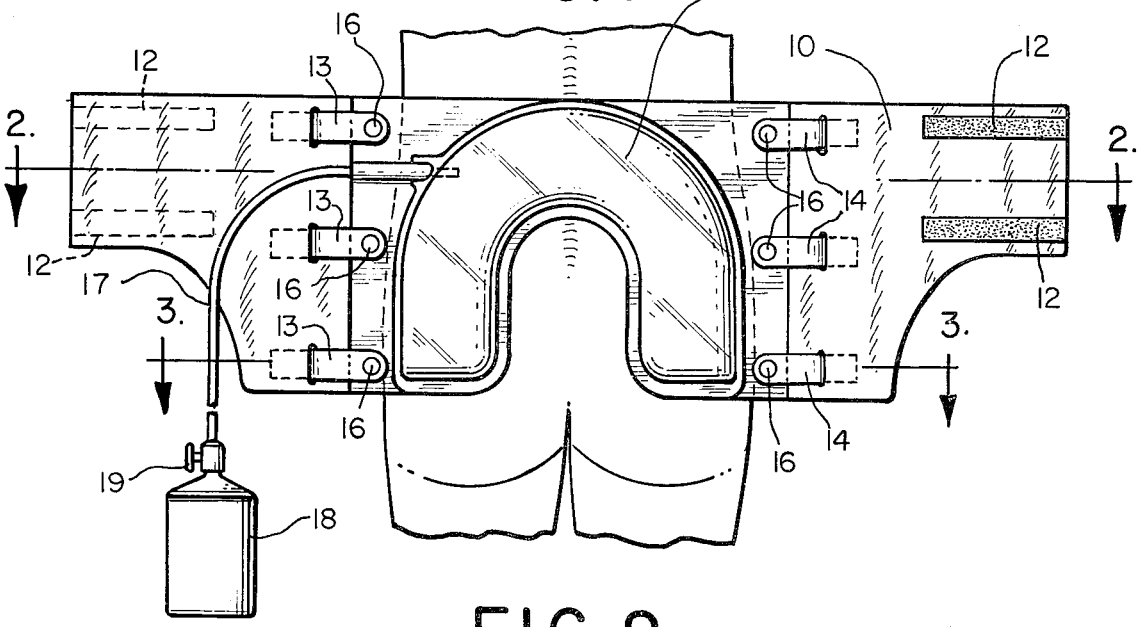
FIG. 1 is an elevational view of one form of the lift device of this invention located adjacent the base of the spine of the patient but with the ends of the base strip extended laterally in order to better disclose the construction.
Figure 2:
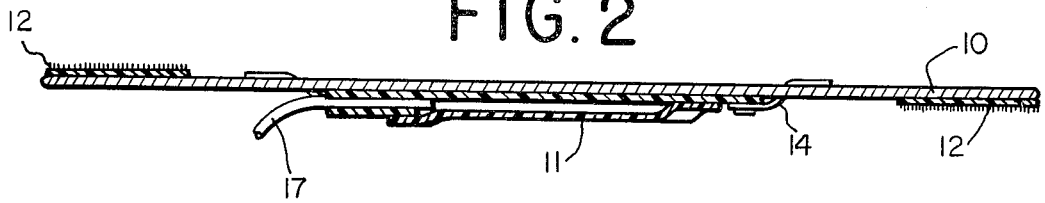
FIG. 2 is a cross sectional view taken along line 2—2 of FIG. 1 and looking in the direction of the arrows.
Figure 3:
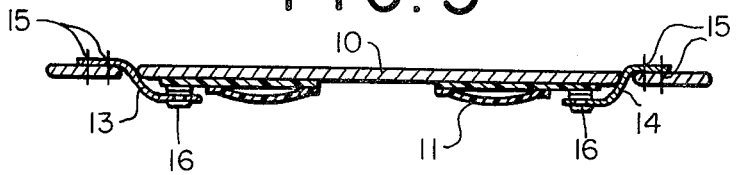
FIG. 3 is a cross sectional view taken along the line 3—3 of FIG. 1 and looking in the direction of the arrows.
Figure 4:
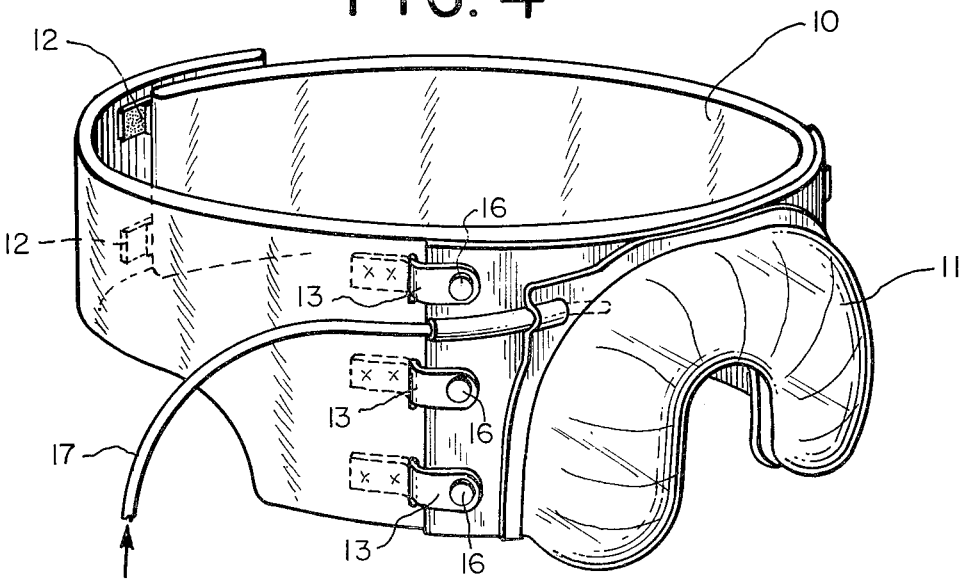
FIG. 4 is an enlarged perspective view of the lift device shown in FIG. 1 with the representation of the patient omitted in order to better reveal the construction.
Figure 5:
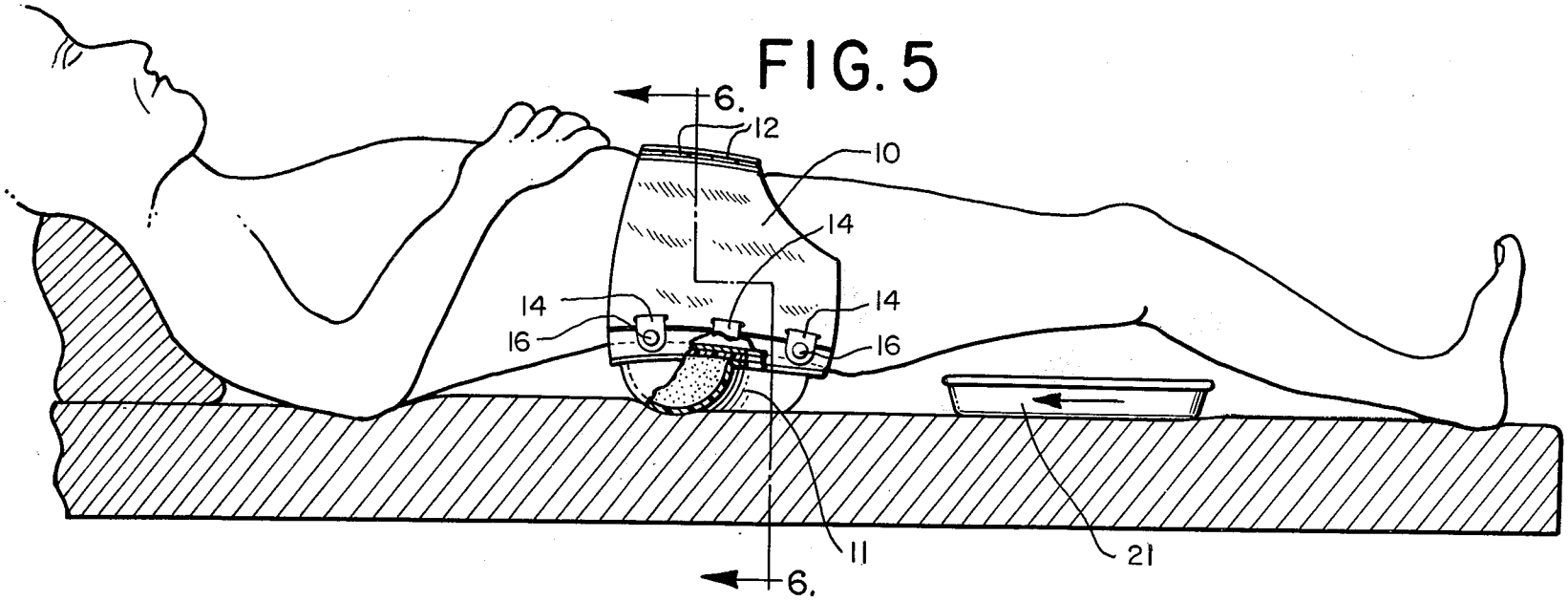
Figure 6:
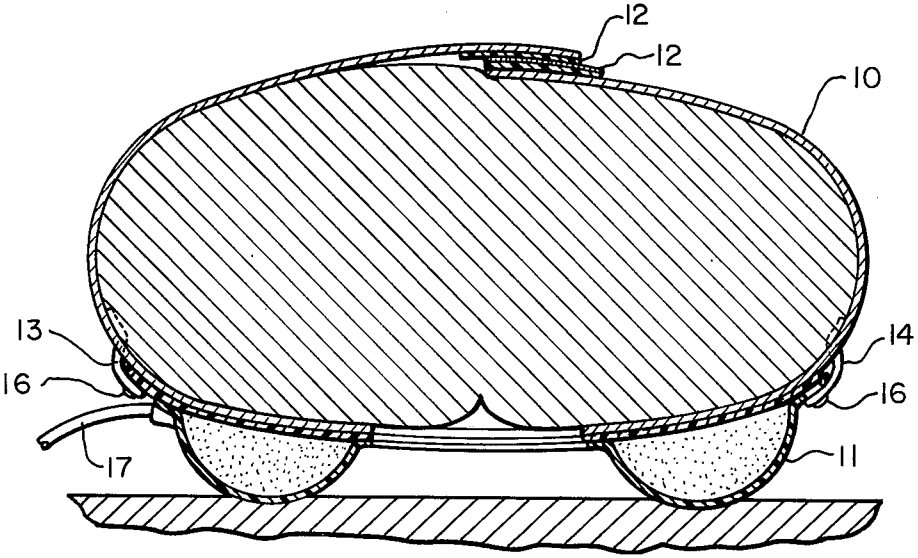

FIG. 5 is a side elevational view with parts broken away of a patient reclining on a bed or similar surface while wearing the lift device of this invention and showing the lift inflated and the torso of the patient in elevated position in readiness for the insertion of a bedpan; and FIG. 6 is an elevational view in cross section taken in the line 6—6 of FIG. 5 and looking in the direction of the arrows.

By reference to the drawings it will be noted that the embodiment of the invention here disclosed comprises a belt like strip 10 which serves as a base member on which an inflatable member 11 is mounted. The belt like member is preferably made of a strong flexible material such as a band of cloth of natural or synthetic fibers which has sufficient length to encompass the lower torso of the patient and to overlap in front to permit the ends to be fastened together by suitable means such as cooperating hook and loop areas 12 of Velcro-like construction. Any other suitable fastening means could be used as desired. In addition the belt like member is of sufficient width to embrace that portion of the patient extending from the base of the spine upwardly to the region of the patients waist. When firmly held on the torso of the patient the belt like strip serves as a means for mounting the inflatable member 11 which is located on the belt like strip and held in place by connecting elastic material 13 and 14, on each side of the inflatable member 11.

The connecting members of elastic material 13 and 14 are connected at their outside ends as by stitching or similar means 15, to the belt like strip 10 and at their inside ends by snaps 16 to the opposite side edges respectively of the inflatable member. The parts are so assembled that when fully deflated, the inflatable member is flat and its side edges are separated to the maximum extent and the connecting elastic members are fully relaxed.

The inflatable member 11 is connected to a flexible tube 17 which in turn is connected to a source 18 of air or gas under pressure which may be released to inflate the inflatable member by means of a control valve 19.

The belt like base member is preferably made of a strong material which is soft and smooth or is provided on its inside surface with a soft and smooth material or surface which will permit the patient to wear the belt while lying in bed with the maximum of comfort.

If desired a single strip of elastic material can be employed on each side of the inflatable member instead of the plurality of separated strips shown in the drawing. Also stitching can be substituted for the snap connections 16. When snaps are employed the inflatable member 11 can be readily removed from and reapplied to the base strip 10 so that each can be separately cleaned and replaced.

In the form here illustrated the elastic strips 13 and 14 are stitched to the inside surface of the belt like strip 10 and extend outwardly through slit-openings in the belt like strip. However, this particular type of attachment is not essential. Furthermore, the belt like strip can be made of a double ply or soft material such as terry cloth or toweling in which case the stitching attaching the elastic strips 13 and 14 can be applied on the inside of the outer layer of the double ply and passed through slit openings in the manner shown in the drawings. Whereas it is not essential, it generally will be desirable to shape the belt like strip so that the bottom edge is cut away in front as illustrated, for better access when using the bedpan.

The inflatable member may be made of any flexible impervious material such as thin sheets of rubberized fabric or plastic. Plastic, such as polyvinyl coloride or polyethylene, may be employed. In such cases the edges of two layers cut to suitable shape may be heat or otherwise sealed so that the inflatable member may be free to balloon out when fully inflated.

An important feature of this invention resides in the fact that the belt like base strip when properly applied to the patient effectively locates the inflatable member so as to be disposed at the region of the base of the patients spine. By so locating the inflatable member it has been found that the device when deflated may be worn by the patient throughout the day and night or for so long as may be necessary without causing the patient serious or objectionable discomfort. The elastic connecting strips and their areas of attachment to the belt like base member and the side edges of the inflatable member are located to the sides of the patient so that when the patient is lying on his back these portions will not be disposed between the patient and the bed surface. In this position the patient has between him and the bed only the thickness of the belt like strip 10 and the two thin layers of the inflatable member 11.

Furthermore by locating the inflatable member adjacent the base of the patient's spine the patient's buttocks may be lifted off of the bed surface when inflation is effected thus avoiding the insertion of lifting means under the patient's buttocks. As a result adequate space is provided under the buttocks of the patient to accommodate a bed pan.

The inflatable device may be of various shapes, such as rectangular, oval, kidney shaped or generally U-shaped as shown in the drawing provided only that it be capable of lifting the patient approximately 3½ to 4 inches off the bed surface when fully inflated. By employing the U-shape here illustrated, additional space 20 is provided for accommodating the leading end of the bed pan when it is introduced under the patient.

I claim:

1. A lifting device for patients reclining in bed comprising a flexible belt-like strip adapted to be wrapped around the lower portion of a patient's torso with its ends attached to each other so as to be worn by the patient during a sojourn in bed, an inflatable member of flexible impervious material mounted on said belt-like strip in a position adjacent the base of the patient's spine, means for attaching said inflatable member to said belt-like strip comprising elastic connecting strips which will yield during inflation of said inflatable member and restore the inflatable member to flat condition when deflated, means connecting said inflatable member to a source of fluid under pressure and means permitting the injection of such fluid into the inflatable member to lift the patient to permit such fluid to be exhausted to lower the patient onto the surface of the bed.

2. A lifting device for patients of the construction defined in claim 1 further characterized in that said belt-like strip and inflatable member can be readily separated by readily releasable fasteners connecting said elastic strips to the inflatable member.

3. A lifting device for patients of the construction defined in claim 1 further characterized in that said belt-like strip and inflatable member are attached by releasable snaps so they can be readily separated.

4. A lifting device for patients of the construction defined in claim 1 further characterized in that said inflatable member is U-shaped with the open end of the U facing downwardly when worn by a patient.

5. A lifting device for patients of the construction defined in claim 1 further characterized in that the ends of the belt-like strip overlap in the front of the patient and are attached to each other by a releasable holding means.

6. A lifting device for patients of the construction defined in claim 1 further characterized in that the ends of the belt-like strip overlap in the front of the patient and are attached by Velcro-like attaching areas.

* * * * *

UNITED STATES PATENT AND TRADEMARK OFFICE

CERTIFICATE OF CORRECTION

PATENT NO. : 4,271,546

DATED : June 9, 1981

INVENTOR(S) : Mary Martin

It is certified that error appears in the above—identified patent and that said Letters Patent is hereby corrected as shown below:

Column 1, line 62, delete "garmentlike" and insert therefor --garment-like--.

Column 3, line 59, delete "coloride" and insert therefor --chloride--.

Column 4, line 43, insert -- and -- immediately after "patient".

Signed and Sealed this

*Twentieth* Day of *October 1981*

[SEAL]

*Attest:*

GERALD J. MOSSINGHOFF

*Attesting Officer*

*Commissioner of Patents and Trademarks*